US006712150B1

(12) United States Patent
Misselbrook et al.

(10) Patent No.: US 6,712,150 B1
(45) Date of Patent: Mar. 30, 2004

(54) PARTIAL COIL-IN-COIL TUBING

(75) Inventors: John G. Misselbrook, Houston, TX (US); Richard A. Altman, Kingwood, TX (US); William G. Gavin, Calgary (CA); Alexander R. Crabtree, DeWinton (CA)

(73) Assignee: BJ Services Company, Houston, TX (US)

( * ) Notice: Subject to any disclaimer, the term of this patent is extended or adjusted under 35 U.S.C. 154(b) by 0 days.

(21) Appl. No.: 10/070,788

(22) PCT Filed: Sep. 10, 1999

(86) PCT No.: PCT/US99/20822

§ 371 (c)(1),
(2), (4) Date: May 1, 2002

(87) PCT Pub. No.: WO01/20213

PCT Pub. Date: Mar. 22, 2001

(51) Int. Cl.[7] ..... E21B 19/08
(52) U.S. Cl. ..... 166/384; 166/387; 166/77.2
(58) Field of Search ..... 166/387, 187, 166/66.4, 65.1, 106, 68, 102, 105, 103, 384, 77.2

(56) References Cited

U.S. PATENT DOCUMENTS

| | | | |
|---|---|---|---|
| 2,041,911 A | 5/1936 | Erickson | 154/44 |
| 2,832,374 A | 4/1958 | November | 138/50 |
| 3,076,760 A | 2/1963 | Markman | 252/8.55 |

(List continued on next page.)

FOREIGN PATENT DOCUMENTS

| | | | |
|---|---|---|---|
| CA | 852553 | 9/1970 | 166/2 |
| CA | 951258 | 7/1974 | 116/66.1 |
| CA | 1059430 | 7/1979 | 166/4 |
| CA | 1161697 | 2/1984 | 116/66.1 |
| CA | 1180957 | 1/1985 | 116/66.1 |
| CA | 1204634 | 5/1985 | 116/66.1 |
| CA | 1325969 | 10/1987 | 166/53 |
| CA | 2112770 | 1/1994 | |
| CA | 2122852 | 5/1994 | |
| DE | 3420937 | 6/1983 | E21B/43/24 |
| WO | WO97/01017 | 1/1997 | E21B/19/22 |
| WO | WO97/35093 | 9/1997 | |

OTHER PUBLICATIONS

Misselbrook, "Novel Approach to Through–Tubing Gravel Packing Utilising Coiled Tubing," SPE 60692, Apr. 5–6, 2000, 8 pp.

Diamond Power Specialty Company, ISIT "Rugged Vacuum Insulated Steam Injection Tubing for Enhanced Oil Recovery," Babcock & Wilcox.

Falk et al., "Sand Clean–out Technology for Horizontal Wells" The Petroleum Society of CIM, Paper 95–97; Appendix: Sand–Vac Case Histories (first 5 jobs); 7 pages, XP–002103546.

"Preprints from the Petroleum Society's Annual Technical Meetings" Petroleum Society of CIM Publications Canadian Institute of Mining, Metallurgy & Petroleum; Technology Publications, Calgary, Alberta, Canada, T2P 3P4, dated Jun. 1, 2000; pp. 1–4.

Cure et al., "Jet–assisted drilling nears commercial use" Oil & Gas Journal, Drilling Technology Report, Week of Mar. 11, 1991, 6 pages.

Hoyer et al., "Test, Treat, Test System Using a Concentric Coiled Tubing/DST Package" The Petroleum Society Paper, 8 Pages.

(List continued on next page.)

*Primary Examiner*—Frank Tsay
(74) *Attorney, Agent, or Firm*—Howrey Simon Arnold & White, LLP

(57) ABSTRACT

A dual tubing coiled tubing string, including methods of assembly, that includes an inner tubing sealed within at least an upper portion of an outer tubing.

40 Claims, 7 Drawing Sheets

U.S. PATENT DOCUMENTS

| | | | | | |
|---|---|---|---|---|---|
| 3,083,158 | A | | 3/1963 | Markman | 252/8.55 |
| 3,361,202 | A | | 1/1968 | Whipple | 166/10 |
| 3,397,745 | A | | 8/1968 | Owens et al. | 166/57 |
| 3,574,357 | A | | 4/1971 | Alexandru et al. | 285/47 |
| 3,643,702 | A | | 2/1972 | Kauder | 138/121 |
| 3,681,240 | A | | 8/1972 | Fast et al. | 252/8.55 |
| 3,698,440 | A | | 10/1972 | Matthieu et al. | 138/149 |
| 3,860,037 | A | | 1/1975 | Rowe | 138/89 |
| 4,019,575 | A | | 4/1977 | Pisio et al. | 166/61 |
| 4,073,344 | A | | 2/1978 | Hall | 166/307 |
| 4,103,320 | A | | 7/1978 | dePutter | 361/215 |
| 4,167,111 | A | | 9/1979 | Spuck, III | 73/155 |
| 4,248,298 | A | | 2/1981 | Lamers et al. | 166/57 |
| 4,252,015 | A | | 2/1981 | Harbon et al. | 73/151 |
| 4,442,014 | A | | 4/1984 | Looney et al. | 252/8.55 |
| 4,470,188 | A | | 9/1984 | Holbrook et al. | 29/445 |
| 4,487,660 | A | | 12/1984 | Netzel et al. | 174/28 |
| 4,565,351 | A | | 1/1986 | Conti et al. | 254/134 |
| 4,579,373 | A | | 4/1986 | Neal et al. | 285/47 |
| 4,607,665 | A | | 8/1986 | Williams | 138/148 |
| 4,624,485 | A | | 11/1986 | McStravick et al. | 285/47 |
| 4,629,218 | A | | 12/1986 | Dubois | 285/176 |
| 4,635,725 | A | | 1/1987 | Burroughs | 166/278 |
| 4,663,059 | A | | 5/1987 | Ford et al. | 252/8.55 |
| 4,698,168 | A | | 10/1987 | Briggs | 252/8.55 |
| 4,744,420 | A | | 5/1988 | Patterson et al. | 166/312 |
| 4,823,874 | A | | 4/1989 | Ford | 166/279 |
| 4,842,068 | A | | 6/1989 | Vercaemer et al. | 166/269 |
| 4,844,516 | A | * | 7/1989 | Baker | 285/351 |
| 4,856,590 | A | | 8/1989 | Caillier | 166/278 |
| 4,860,831 | A | | 8/1989 | Caillier | 166/384 |
| 4,898,236 | A | | 2/1990 | Sask | 166/65.1 |
| 4,921,018 | A | | 5/1990 | Dridi et al. | 138/149 |
| 4,940,098 | A | | 7/1990 | Moss | 175/320 |
| 4,979,563 | A | | 12/1990 | Patel | 166/250 |
| 5,033,545 | A | | 7/1991 | Sudol | 166/312 |
| 5,034,140 | A | | 7/1991 | Gardner et al. | 252/8.553 |
| 5,086,842 | A | | 2/1992 | Cholet | 166/312 |
| 5,101,918 | A | | 4/1992 | Smet | 175/424 |
| 5,160,769 | A | | 11/1992 | Garrett | 428/36.5 |
| 5,236,036 | A | | 8/1993 | Ungemach et al. | 166/77 |
| 5,285,846 | A | | 2/1994 | Mohn | 166/61 |
| 5,287,741 | A | | 2/1994 | Schultz et al. | 73/155 |
| 5,348,097 | A | | 9/1994 | Giannesini et al. | 166/385 |
| 5,351,533 | A | | 10/1994 | Macadam et al. | 73/155 |
| 5,353,875 | A | | 10/1994 | Schultz et al. | 166/297 |
| 5,388,650 | A | | 2/1995 | Michael | 175/71 |
| 5,411,105 | A | | 5/1995 | Gray | 175/69 |
| 5,419,188 | A | | 5/1995 | Rademaker et al. | 73/151 |
| 5,429,194 | A | | 7/1995 | Nice | 166/383 |
| 5,435,395 | A | | 7/1995 | Connell | 166/384 |
| 5,503,014 | A | | 4/1996 | Griffith | 73/155 |
| 5,577,560 | A | * | 11/1996 | Coronado et al. | 166/387 |
| 5,638,904 | A | | 6/1997 | Misselbrook et al. | 166/384 |
| 5,671,811 | A | | 9/1997 | Head | 166/346 |
| 5,992,468 | A | | 11/1999 | Dwiggins | 138/108 |
| 6,015,015 | A | | 1/2000 | Luft et al. | 166/384 |
| 6,497,290 | B1 | * | 12/2002 | Misselbrook et al. | 166/384 |
| 6,527,050 | B1 | * | 3/2003 | Sask | 166/299 |

OTHER PUBLICATIONS

"Application of Insulation Coiled Tubing." The Technical Information Exchange, R.I.E. Issue 9, 1 page.

The Nowsco International.; Issue 1 1995; 2 pages.

Liderth,"Elan Showing Positive Single–Well SAGD Results" Daily Oil Bulletin, p. 3, Tuesday, May 2, 1991 by; Fig. 6 drawing, 2D15–16–36–28 W3M Steam Pilot single Well SAGD, 1 page; Fig_drawing, High Temperature Bottomhole Temperature Measurement System (Morep System, 1 page; Unique Insulated Coiled Tubing System; 1 page.

1985 Derwent Publications Ltd.; Theobalds Road, London WC 1x BRP, England; US Office: Derwent Inc. Suite 500, 6845 Elm St. McLean, VA 22101; Unauthorized copying of this abstract not permitted; 885–007 492/02 HO1 Q49 Zapp–24306.83, Zappey BV, *DE3420–937–AM 24.06.83–NL–002251 (Mar. 1, 1985) E21b–43/24, Steam injection pipe–with couplings permitting telescopic, sealed movement of section due to temp. differences.

Canada Supplement No. 80, Apr., 1998, 2 pages; Venezuela Supplement No. 78, Aug. 1997; 1 page, Manual Industrial Property by 1998.

Nowsco , "*Underbalanced Drilling*", 7 pages.

Halliburton "*New Management Tool For Multi–Layered Reservoirs Perforates and Tests Scattered Pay Zones in One Trip*"; 1 page.

Xerox Telecopier, dated Apr. 5, 1995; Circle DPN 383—Nov. 1994; 1 page.

Patent search Dewaxing Control Apparatus For Oil Well.

Nowsco , "*Drill Stem Testing With Concentric Coiled Tubing Current Status*", 7 pages.

"*Horizontal Wells A new Method for Evaluation & Stimulation*" Downhole Systems Technology Canada Inc., (03) Jun. 1994; 11 pages.

Nowsco , "*Coiled Tubing Services.*" 18 pages.

Norman G. Gruber, et. al. "*New Laboratory Procedures For Evaluation For Drilling Induced Formation Damage and Horizontal Well Performance*" pre–printed for presentation at the Canadian SPE/CIM/CANMET International Conference on Recent Advances in Horizontal Well Applications; Mar. 20–23, 1994, CALGARY.

Kelly Falk, et al; "*Concentric CT for single–well, steam–assisted gravity drainage A new recovery process that uses concentric coiled tubing has been developed to improve production capabilities in heavy oil regions*" World Oil/Jul. 1996, pp. 85–94.

D. P. Aeschiman, et al, "*THERMAL Efficiency of a Steam injection Test Well With Insulated Tubing*" Society of Petroleum Engineers of AIME, presented at the 1983 California Regional Meeting held in Ventura California, on Mar. 23–25, 1993; 14 pages.

S.J. Fried, et al, "*The Selective Evaluation and Stimulation of Horizontal Wells Using Concentric Coiled jTubing*" Society of Petroleum Engineers of AIME, presented at the 1996 SPE International Conference on Horizontal Well Technology held in Calgary, Canada, Nov. 18–20, 1996; 8 pages.

Nowsco, Coil in Coil 'Select–Test' System Sour Well DST's/Horizontal Well Evaluations & Stimulations, 1 page.

PCT International Search Report dated Jun. 2, 1997.

* cited by examiner

PARTIAL COIL-IN-COIL TUBING

FIELD OF INVENTION

The invention relates to coiled tubing strings, and in particular to at least partial dual tubing strings, including methods for assembling such strings.

BACKGROUND OF INVENTION

This invention is tangentially related to U.S. Pat. No. 5,638,904—Safeguarded Method and Apparatus for Fluid Communication Using Coiled Tubing, With Application to Drill Stem Testing—Inventors Misselbrook et al.; PCT Application US 97/03563 filed Mar. 5, 1997 for Method and Apparatus using Coil-in-Coil Tubing for Well Formation, Treatment, Test and Measurement Operations—Inventors Misselbrook et al; and U.S. Ser. No. 08/564,357 entitled Insulated and/or Concentric Coiled Tubing.

The instant invention relates to apparatus and assembly for at least a partial dual tubing or "coil-in-coil" tubing string, sometimes referred to as PCCT, wherein an inner tubing is sealed within an outer coiled tubing. It is to be understood that although the term coil-in-coil may be used, the "inner tubing" need not necessarily be "coiled tubing", or "coiled tubing" as it is known or practiced today. Standard "coiled tubing" as the "inner tubing" does afford a practical solution for first embodiments. The inner tubing, however, could comprise a liner, for instance. Further, there may or may not be an annulus per se defined between the inner and the outer tubing, in whole or in part. Any annulus formed is preferably narrow.

Since providing dual tubing in a string should raise the cost of a string, there may be a cost advantage to minimizing the length of the dual portion. Hence, "partial" coil-in-coil strings, or PCCT, may have cost advantages. A general purpose multi-use partial dual string should have enough dual length to cover the anticipated length of well interval to be serviced. The overall length of the PCCT string will be chosen to service a typical depth range of wells in a particular location. But, coiled tubing may be added or removed from the bottom of the outer coiled tubing string to suit wells outside of the standard depth range. A full dual tubing string, of course, would perform adequately but would be more expensive. Alternately, a partial dual string could be formed by connecting a full dual portion with a single portion. Such a partial dual string could be pre-formed and transported to a job or formed at a job site.

A key purpose for using an at least partial dual string is to provide a protective barrier at the surface to enable safe pumping of well fluids up or down. (Surface is used generally herein to refer to above the wellhead.) To provide this benefit, a dual string has a sealed annulus or the tubings are sealed together, in whole or in part. A dual tubing string annulus preferably would be sealed at or proximate a lower end of the inner tubing, and the seal is preferably located across the annulus between the inner and outer coiled tubing, most preferably within the outer coiled tubing. Preferably also, any annulus would be narrow, to maximize working space. Means can be provided to monitor fluid status, such as fluid flow or pressure, within any annulus formed. A pressurized fluid such as nitrogen could be injected, for instance, into the annulus, or existing fluid within an annulus could be pressured up.

Coiled tubing is commonly utilized in well servicing for working over wells. In a workover, a continuous coiled tubing string is injected into a live well using an associated stuffing box located over the wellhead. Many coiled tubing workovers take place under live well conditions. Coiled tubing has proven particularly useful when working through production tubing or completion tubing.

In normal operations coiled tubing is over-pressured vis a vis well pressure. This insures that were any leaks to develop in the tubing, they would result in flow out of the tubing rather than the reverse, which is important for safety reasons. Pressure in the coiled tubing also keeps well fluids from backing up the tubing bore. Well fluids are relegated to the annular space between the coiled tubing and the production tubing or completion tubing. If produced up the annular space outside the coiled tubing, well fluids can be handled in the usual safe manner at a wellhead.

Fluids pumped down through a coiled tubing string typically enter the tubing at a valve located upon an axle of the reel carrying the string. The fluids run through the remaining tubing wound around the reel, over the gooseneck, down the injector, through the stuffing box, through the wellhead and down the wellbore. Any fluids pumped down a coiled tubing string thus may traverse a significant length of tubing on the surface.

The instant invention anticipates that some live well applications could be more effectively performed with coiled tubing if well fluids were permitted to be circulated up through the tubing rather than up the annulus. For some applications, for instance, the annulus outside of the tubing provides a more effective path for pumping down, leaving the bore for reverse circulating up. E.g., a gravel pack might be more effective if a gravel slurry, were pumped down the broader production tubing—coiled tubing annular region than down the narrower coiled tubing bore. Higher circulation rates might be achieved by pumping the slurry down the annulus. This is particularly true because fluid pumped down the bore must pass through a crossover tool near the bottom. Coiled tubing pack-off and crossover tools can be expensive, and the narrow flow paths inherent in miniature tools offer potential sites for blockages. A potential benefit of the proposed system lies in the elimination of the need for complex combination pack-off and crossover tools. Eliminating coiled tubing crossover tools and their associated packers could lead to improved reliability of operations. The proposed system could also alleviate bridging and lead to improved sand pack uniformity.

Another application where a coiled tubing bore offers a more efficient channel for circulating well fluids up a well than the completion-coiled tubing annulus is a well cleanout. Well cleanout requires raising sand, gravel or particulate matter collected at the bottom of a wellhole. Raising particulate matter, without it settling out, necessitates establishing an upward flow velocity that is a certain multiple of the settling velocity of the particles in the liquid. Additional difficulty and complexity occurs when raising particulate matter in deviated wells. As a result quite high flow rates may be needed to effect a sufficient liquid velocity in an annulus to carry particles up. Sometimes the flow rates required are only achievable using the larger sizes of coiled tubing which can be impractical or else uneconomic. Since the annulus between a coiled tubing and completion typically has a larger cross-sectional area than the tubing bore itself, a lesser flow rate pressure would be needed to achieve the same fluid velocity up the bore.

A third live well application for a dual coiled tubing string in accordance with the instant invention lies in using potentially readily available natural gas to unload liquid from live wells. When natural gas is available at a wellhead, from either the same or neighboring wells, such gas may be quite cost effective as a gas lift fluid. However, pumping natural gas down through coiled tubing must be protected at the surface above the wellhead. Personnel and the environment must be safeguarded from leaks that could develop in the coil before the gas passes below the wellhead.

Historically, transporting well fluids at the surface above a wellhead through normal coiled tubing has been deemed hazardous. Such is currently banned for most offshore operations and is generally unacceptable for many land operations. Coiled tubing becomes bent beyond its yield point when moved off a reel and over a gooseneck by an injector. This plastic bending activity typically takes place with a high pressure applied to the interior of the tubing. A pressure differential across the tubing wall during bending increases stress levels in the tubing and accelerates the onset of fatigue cracking. Chemicals used in well operations occasionally tend to pit and corrode tubing material. Chemical corrosion and accumulated fatigue can ultimately lead to small cracks in the wall of the tubing, culminating in a "pin-hole" in the tubing. While it is possible to limit the incidence of "pure fatigue pin holes" by careful management of the fatigue cycles experienced by the tubing, other stress in the tubing can lead to unexpected and premature pin-holes. Today most pin-holes in coiled tubing propagate from stress risers caused by corrosion, the most common cause of such pin-holes being internal pitting from chloride corrosion. Because chlorides are common in the oilfield (seawater, NCI, $CaCl_2$, etc.) it is almost impossible to eliminate the possibility of a corrosion pit. The second most common corrosion mechanism is stress corrosion cracking (SCC) arising from exposure to hydrogen sulfide.

A leak of well fluid through a crack or a pinhole in a string between the wellhead and a reel endangers life and the environment. A small hole or crack functions as an atomizer, spraying pressurized fluid from within the tubing to the surroundings above ground. A pooling of leaked gas could be ignited by a spark. Hydrogen sulfide or the like might be contained within the well fluid, to mention another danger.

The crux of the problem with the transportation of well fluids on the surface in coiled tubing is that between the wellhead and the reel valve there is no protective barrier for the crew and the environment against leaks from the tubing. The possibility of leaks is not sufficiently remote. A dual tubing string, or an at least partial coil-in-coil tubing, as taught by the present invention, can cost-effectively provide the needed double barrier to permit well fluids to be safely circulated up or down on the surface through coiled tubing as may be particularly suitable in certain operations.

Since a double barrier is crucial when the well fluids travel between the wellhead and the surface valve, an inner tubing in a dual string should be at least long enough, taking into account the wells and their intended applications, to extend on the surface from a reel connection through a wellhead during the critical pumping or "reverse circulation" operation.

SUMMARY OF THE INVENTION

The instant invention of an at least partial dual tubing string comprises an inner tubing within an outer coiled tubing for at least an upper portion of the string. Preferably the inner tubing is equal to or less than 80% of the length of the outer tubing. Preferably also the outside diameter of the inner tubing is greater than or equal to 80% of the inside diameter of the outer tubing. The inner tubing is sealed against the outer tubing at at least a lower portion of the inner tubing.

In one embodiment a seal is structured to permit some longitudinal movement between an end of the inner tubing and the outer tubing. Preferably the seal is located within the outer tubing. Alternately a seal may fix, or cooperate with an element that fixes, the relative location of an end portion of the inner tubing with respect to the outer tubing.

An upset or stop may be attached or formed onto an inner wall of the outer tubing. The stop may be positioned to limit longitudinal movement of an end of the inner tubing relative to outer tubing. The inner tubing may be inserted such that it is compressed against and biased against the stop within the outer tubing. Preferably any annulus defined between the inner tubing and the outer tubing is quite narrow. The inner tubing could be of the same or of different material as the outer string. Conveniently, the inner tubing could be coiled tubing of slightly smaller diameter. Preferred materials for the inner tubing include aluminum, titanium, beryllium-copper, corrosion resistant alloy materials, plastics with or without reinforcement, composite materials and any other suitable material.

In some embodiments, an inner tubing would run at least ½ of the length of the outer tubing, and preferably approximately ¼ to ⅓ of the length of the outer tubing.

Fluid or pressurized fluid may be inserted in a defined annulus between the tubings and its status or pressure monitored. A fluid, such as nitrogen gas may be provided in the annulus. Changes in the pressure of this annulus fluid would indicate a leak in either the inner tubing or the outer tubing. In either case the well could be shut in and work stopped to maximize the safety of the crew and the environment.

As a further safety measure, a safety check valve may be attached to a lower end of the string.

It is possible to construct a "composite" string out of single coil and full or partial coil-in-coil by prejoining them or by delivering both on one spool to a job and joining them together into one string with a connector or a weld as they are being run into the well.

The invention further includes a method for assembling partial coil-in-coil or dual tubing. In one embodiment a tubing string may be assembled by inserting an upper end of an inner tubing into a lower end of an outer tubing and moving the upper end of the inner tubing to an upper end of the outer tubing. This method may include reeling the assembled string onto a first reel and then re-reeling the string onto a second reel. An advantage of such method of assembly is that a directional sliding seal may be attached to the lower end of the inner tubing prior to inserting that lower end into the lower end of the outer tubing. This directional seal may slide relatively easily in one direction, e.g. the direction of insertion, but resist sliding and rather vigorously against the inside wall of the outer tubing when the inner tubing is attempted to be moved in the opposite direction.

In another embodiment, the inner tubing may be welded or connected at its lower end to a sealing section, such as a slip mandrel. The sealing may be designed to be swaged out, or forced out by a slip, to form a mechanical fixed connection between the tubings. Fluid seals can back up the mechanical connection.

Another method for assembling partial coil-in-coil tubing may include affixing a stop on an inside wall portion of the outer tubing. The stop would be fixed at a location suitable to limit longitudinal motion of an end of an inner tubing within the outer tubing. A stop may be readily introduced on to the flat steel strip at the time of manufacture of the outer coiled tubing string. A stop could be useful if a fixed seal were to be effected between the inner tubing and outer tubing, or if relative movement between the tubings is to be restricted. The inner tubing could be assembled in the outer tubing so as to be compressed against and bias against the stop.

In a further method for assembling a working coiled tubing string, a length of regular coil and a full coil-in-coil length can be welded or connected or delivered to a job unconnected, including on one reel. A single coil and a double coil can be made into one string on a job by manually joining a stringer with a connector as they are run into a well.

Seals my be activated by mechanical means, chemicals, radiation, or heat. The inner tubing may be a liner glued, secured by adhesive, or fused in place. A liner might even be formed in place within the outer tubing.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF PREFERRED EMBODIMENTS

Narrow, when used herein to refer to a narrow annulus, is intended to refer to a dual tubing or coil-in-coil annulus wherein the OD of an inner tubing is slightly smaller than the ID of an outer tubing. The difference between the OD and ID might be $1/10^{th}$ of an inch or even less. Lower, as used herein in reference to coiled tubing, refers to portions of a string toward a distal end of the string, the end not connected to the reel in use. Upper refers to tubing portions proximate a string end connected to the reel in use. A tendency for longitudinal movement of an inner tubing relative to an outer tubing during reeling out and in is discussed below. It should be understood that a seal that is structured to permit and cooperate with such longitudinal movement might also permit axial or rotational or other sorts of movement as well. Such other movement is not intended to be excluded. Generally, the phrase "on the surface" refers to above the wellhead. Coiled tubing, as known in the art, is coiled upon a truckable reel. An upset on a tubing inner surface may be generally referred to as a stop. A weld bend is a prime example of such a stop. Circulating well fluid through a string includes moving any potentially hazardous well fluid up or down coiled tubing where the fluid traverses tubing portions on the surface, which is where protection afforded by a double tubing or double wall could be important.

Figure 1:
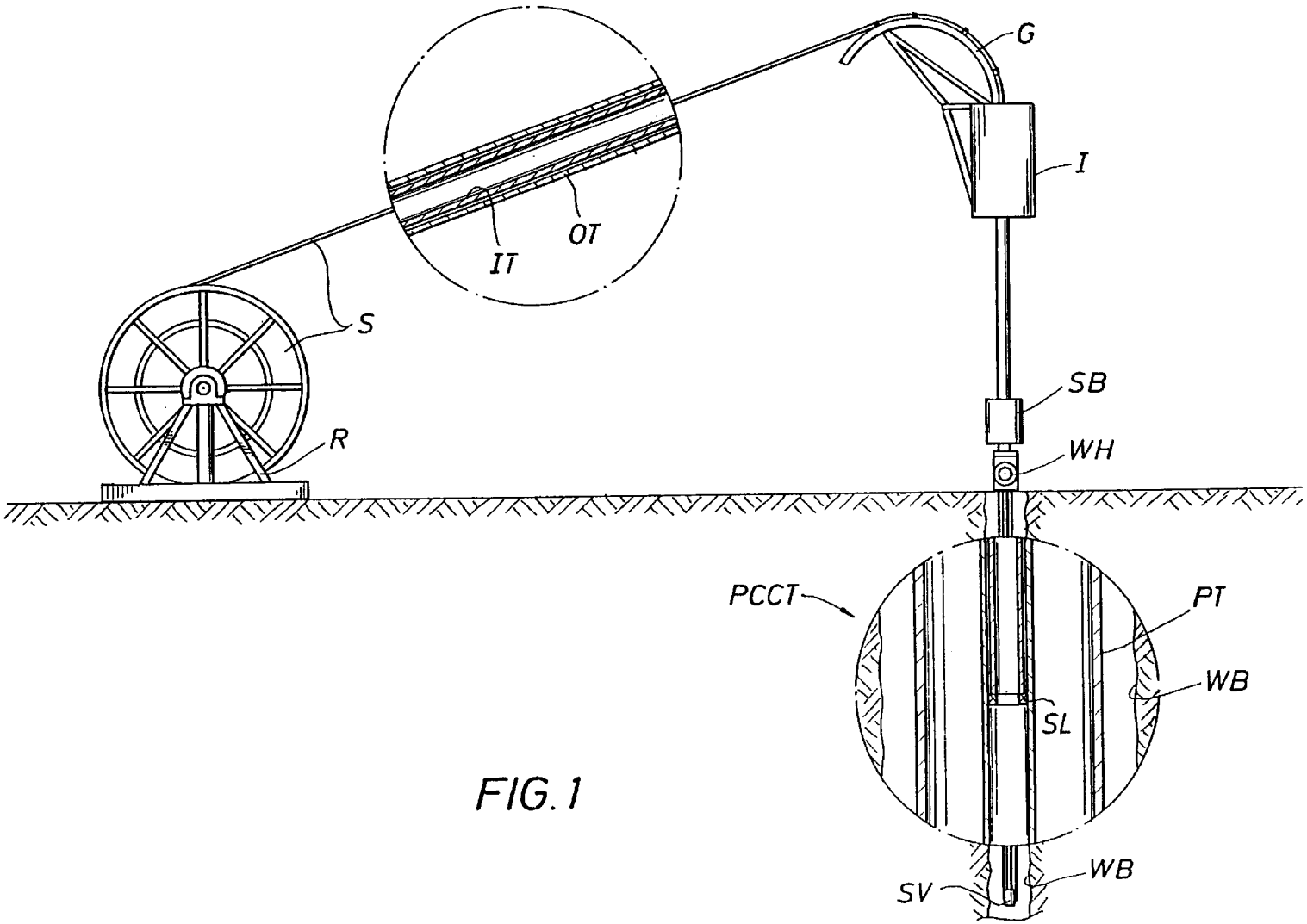
FIG. 1 illustrates a partial coil-in-coil tubing string in a well.

FIG. 1 illustrates in general a coiled tubing strings, and in particular a partial coil-in-coil string embodiment, PCCT, inserted in a well. Truck T (not shown) carries reel R having string S. String S carried on reel R contains, for a portion of its upper length, inner tubing IT within outer tubing OT. As deployed, inner tubing IT extends beneath wellhead WH in wellbore WB. Seal SL seals the annulus between inner tubing IT and string S proximate an end of inner tubing IT. Subsequent figures illustrate favored sealing systems in detail. Of course PCCT could be formed by connecting a sealed full dual coil, at SL, with a lower length of single coil.

Preferably, the outer diameter of inner tubing IT is only slightly smaller than the inside diameter of outer tubing OT of string S, yielding a narrow annulus. For instance a 1 3/16 inch OD inner coiled tubing string might be inserted into an approximately 1½ inch OD outer coiled tubing string. In attempting to create coil-in-coil with such a narrow annulus, considerations of the possible ovality of each tubing should be taken into account, as well as wall thickness and available methods and techniques for insertion.

The wellbore WB in FIG. 1 illustrates production tubing PT within the well together with a coiled tubing string, although not to scale. In practice, operating coiled tubing through production tubing places a significant constraint on the maximum outside diameter of a string that can be used, in general.

As is known in the art, in FIG. 1 coiled tubing string S is shown winding from reel R over gooseneck G, through injector head 1, through stuffing box SB, through wellhead WH and then downhole. FIG. 1 also illustrates a safety valve sub SV attached to the bottom of coiled tubing string S. Operating in a live well suggests that not only should there be a double barrier between the wellhead and a tubing valve, which is located typically on a reel, when producing up the tubing or flowing well fluids in the string, but also that there possibly should be an extra safety factor such as a safety valve at the end of the coiled tubing string. The safety valve is particularly useful when the coiled tubing string is being pulled out of the hole and the end of any inner tubing is reeled up past the wellhead. A safety valve sub compliments the functionally of an at least partial dual tubing string.

Figure 2:
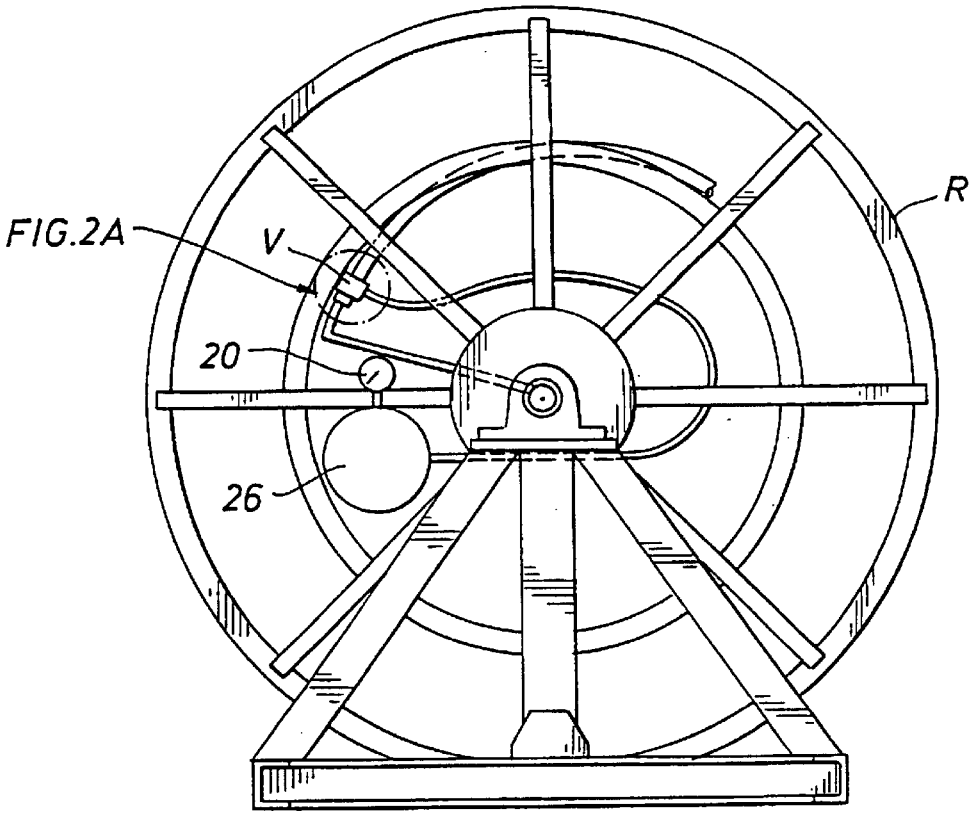
FIGS. 2 and 2A illustrate a coiled tubing reel and valving associated therewith for coil-in-coil or a dual tubing string.
Figure 2A:
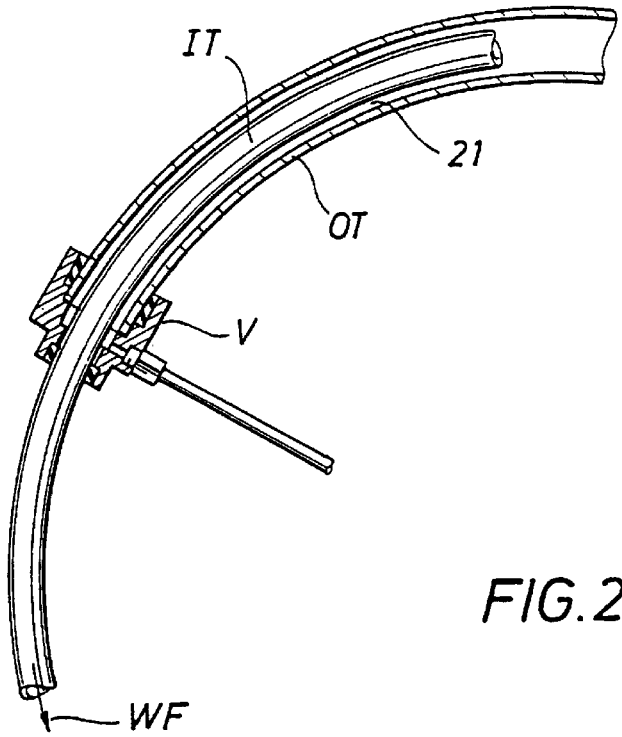

FIGS. 2 and 2A illustrate valving mechanism systems that can be located on coiled tubing reel R. Rotating joint valving mechanisms for normal coiled tubing are known in the art and are indicated but not shown in detail. The tubing string reeled on reel R in FIGS. 2 and 2A is indicated as having outer tubing OT and within it inner tubing IT. At the reel, inner tubing IT could be conveying well fluid WF in accordance with the instant invention, and thus inner tubing IT should extend through the reel to a valve such as a conventional rotating joint valve. Outer tubing OT may be terminated at a convenient point on the reel, as at pack-off assembly V. Pressurized gas container 26 is illustrated as available for pressuring up annulus 21 between the inner tubing IT and outer tubing OT. Gage 20 is illustrated on reel R, attached and located for indicating the pressure being maintained in the annulus between inner tubing IT and outer tubing OT. Annulus 21 might be pressured up to 500 psi with nitrogen in practice. Preferably, gage 20 would transmit signals to a cab or the like on truck T for convenient readout, or at least be easily visible. Preferably the operator of truck T could conveniently monitor the pressure on gage 20.

It should be understood that the inner tubing could be a liner, and not even coiled tubing. The liner could define an annular space within the outer tubing or fit against, in whole or in part, the outer tubing wall. The liner could be pre-formed or could actually be formed in place in the first instance within the outer tubing. A liner could be fused, glued, or secured by adhesive, in whole or in part, to the outer tubing. Cryogenic methods could be used to shrink a liner during installation. Heat, chemicals or radiation could be used to effect a seal.

Any seal of an inner tubing, be it coiled tubing, liner or otherwise, that significantly increases the stiffness of even a portion of a string may adversely affect string lifetime. The choice of seal between the tubing, thus, must take into account the effect of the seal on the practical lifetime of the string or it is coiled and uncoiled.

It should further be taken into account when designing seals that coiled tubing, although coilable on a truckable reel, is yet relatively stiff. Experience indicates that an inner tubing, where the inner tubing also comprises coiled tubing, will tend to assume a maximum possible diameter when coiled on a reel R inside of an outer tubing OT. Thus, the mean diameter of an inner coil IT would likely be slightly larger than the mean diameter of an outer coil OT when the string is coiled on a reel. Hence, per coil on the reel, inner coil IT will be slightly longer than outer coil OT. When such a coil-in-coil string S is straightened out, as when injecting the string into a wellbore, the inner coil, being slightly longer, should tend to want to move longitudinally down with respect to the outer coil and should press against elements impeding such movement. Alternately, the inner coil may tend to retreat within the outer coil when reeled in.

With the above in mind, as illustrated the in embodiments of FIGS. 3, 4, 5 and 6, several sealing systems are particularly considered for use in an at least partial dual tubing string. A seal isolates from fluid communication at least one end of, if not the whole of, an annulus or space formed between an inner tubing and an outer coiled tubing. Preferably, the seal is at least attached proximate to the lower end of the inner tubing and preferably seals against the ID of an outer coiled tubing.

Seals with low mechanical strength may not anchor themselves against an outer coiled tubing string. Methods to reduce or restrict relative movement of the tubings, including seals or means that anchor and other elements such as deformable tubes or slips that anchor, may be desirable. It is important, however, that any sealing and/or fixing mechanism retain itself sufficient flexibility to withstand repeated coiling and uncoiling of the string as it spools on and off a reel. Thus, methods to fix or reduce tubing movement should not significantly compromise the bending flexibility of the string and seal.

A simple internal upset or stop in an outer coiled tubing may be arranged (such as by a miniature weld bead). The inner tubing could then be landed against this upset. By further ensuring that the inner tubing is slightly longer than the measured length of the space it is to occupy within the outer coiled tubing, elastic deformation of the string can help ensure that the inner tubing is always positively engaged against this upset, thus reducing possibility of relative longitudinal movement, at least at the inner tubing distal end.

Alternatively, seals maybe chosen that can themselves be mechanically deformed to a certain extent while retaining a fixed relationship at their ends to tubing wall surfaces. A bellows seal is a prime example. Friction can help limit relative tubing surface-seal movement, while some relative tubing movement is absorbed by deformable portions of a seal.

One method to seal an at least partial dual tubing string entails drilling a small hole in the outer tubing and either welding, brazing, soldering or gluing the two tubings together. The method could include inserting a screw to mechanically restrict movement. Similarly, a hole could be drilled in the outer tubing to allow the injection of a sealing compound after a liner has been inserted. A disadvantage of drilling holes, however, is the necessity to ensure that the subsequent repair of the hole eliminates all stress risers which otherwise would limit the plastic fatigue life of a coiled tubing string.

Conventional self-energized seals that permit movement may be utilized between the tubings, as listed below. One should be careful to control damage to such a seal when installing the inner tubing and seal into the outer coiled tubing.

Elastomer Seals Including:
- O-Rings, Vee or U Packing, PolyPaks, T Seals, Cup Seals
  - With and without backup rings Spring Energized seals including:
- Variseal, Canted Spring Seals
  - With and without backup rings Self Lubricating Seals including:
- Kalsi Seals®
  - With and without backup rings Chemically set seals are possible, in particular as listed below. This type of seal is energized chemically once the seal is set in position. In this way the seal is less likely to be damaged when an inner tubing is installed in an outer coiled tubing. Care should be taken in achieving consistent mixing of appropriate chemical compounds in order to make the seal reliable.

- Elastomer solvent combinations;
- Epoxy systems;
- Soldering or Brazing the inner string to the outer string; and
- Welding the inner string to outer string.

Elastomers subjected to radiation are also a possible choice. With this type of sealing system, a seal is energized by radiating the seal once it is in position. In this way again the seal would be less likely to be damaged when the inner tubing is installed in the outer coiled tubing. Use in the field, however, could place practical limitations upon the use of this technique.

Heat set seals are possible, in particular as listed below. This type of seal is energized by heating the seal once it is in position. In this way the seal would not be damaged when the inner tubing is installed in the outer coiled tubing. To be practical to use in the field, materials are preferably be selected such that energizing temperatures are moderate.

- Elastomer subjected to heat;
- Elastomer soaked in appropriate chemical and subsequently warmed/heated after installation.
- Memory metals Alternately cryogenic methods could be utilized to shrink tubing or tubing portions or a seal during insertion, such than a tight fit results when the elements return to ambient temperatures.

Mechanically set seals are possible, in particular as listed below. This type of seal is energized by mechanical means once it is in position. In such a way the seal is less likely to be damaged when the inner tubing is installed in the outer coiled tubing.

Figure 4:
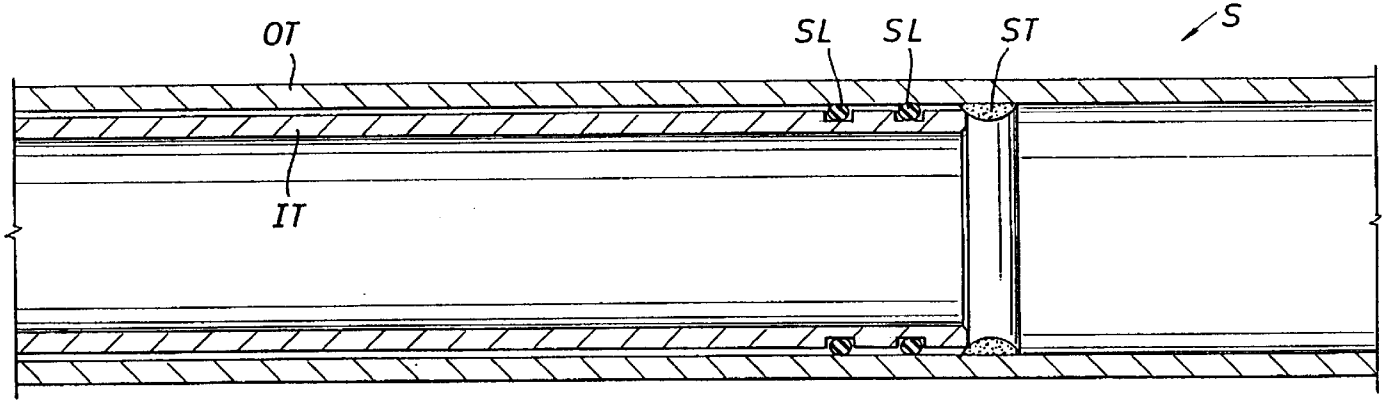
FIG. 4 illustrates sealing an inner tubing within a coiled tubing string including stops on an inside wall of the tubing string.

- Deforming a metal backed elastomer seal into the outer string
- Deforming a non elastomer, plastic or metal seal into the outer string Sealing mechanisms, as illustrated in FIG. 4 should take into account and may even utilize a tendency of an inner coil IT to move longitudinally downward with respect to an outer coil OT as a dual tubing string S is unreeled and straightened. FIG. 4 illustrates upsets or stops ST formed on an inner surface of an outer tubing OT. One convenient means for forming stops ST is to place beads of weld on a strip of metal before it is formed into coiled tubing e.g. before the strip is curled and welded. Such stops ST placed on the inside surface of outer coil OT can thus be used to limit or inhibit substantial longitudinal movement of an end of inner tubing IT within an outer coil OT. Such limitation of longitudinal movement could help support fixed seals SL, illustrated as O-rings in FIG. 4, between inner tubing IT and outer coil OT. Compression of inner coil IT within outer coil OT, together with a tendency of coil IT to move downward upon deployment, can both assist in biasing inner coil IT against stops ST.

Figure 3A:
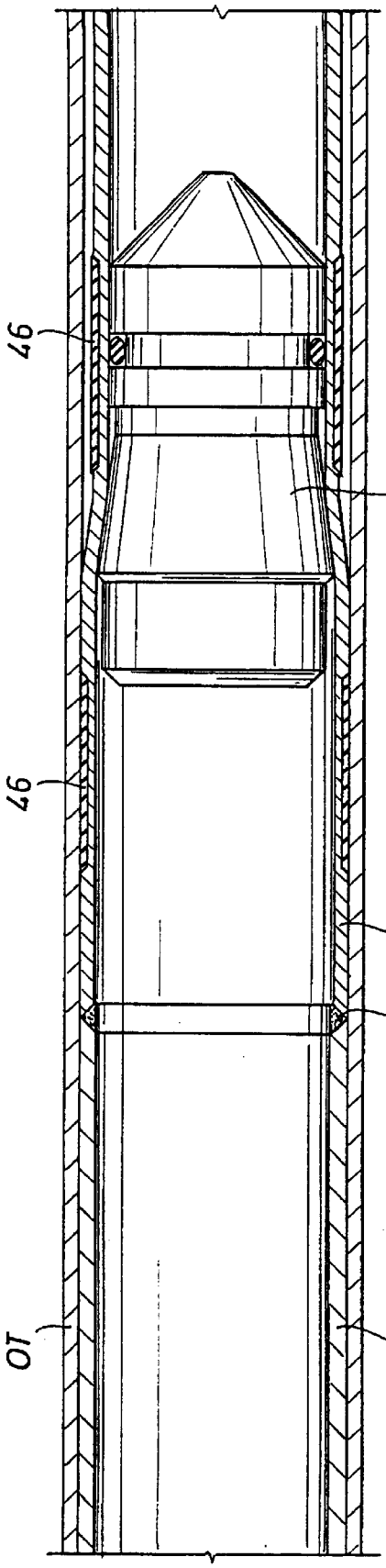
FIGS. 3A–3D illustrate fixed seal systems.
Figure 3B:
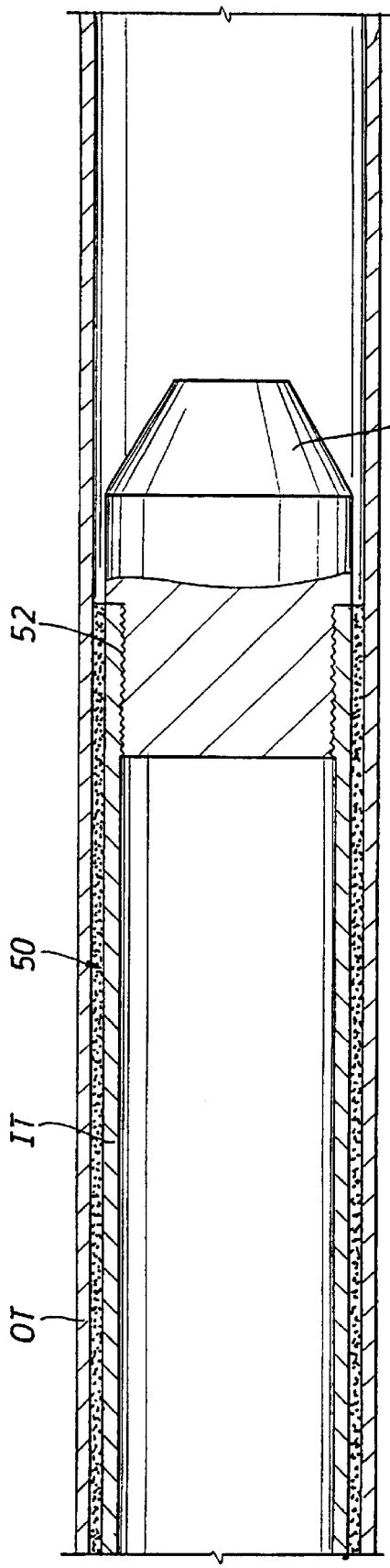

Fixed seal ports P could be drilled through the outer coil to help effect or establish a seal in practice after assembly, such as with screws, as illustrated in FIG. 3B.

FIG. 3A illustrates a seal system between inner tubing IT and outer coiled tubing OT that is mechanically set and fixes the tubings against relative longitudinal movement. The seal system does not permit longitudinal movement between inner tubing IT and outer tubing OT after being set. The seal system includes deformable tube 44 connected or welded to the bottom of inner tubing IT at well 42. Deformable tube 44 might have a length of 6 to 10 feet. Inserted periodically around deformable tube 44 are elastomeric seals 46. After inner tubing IT is located within outer tubing OT, plug 48 is pressured down the string. Upon reaching deformable sleeve 44 plug 48 deforms tube 44 plastically outward to compress against and fit against the inner wall of outer tubing OT, pressing thereby the series of elastamer seals 46 tightly against the inner wall of outer tubing OT.

FIG. 3B illustrates a flexible liner sealed with adhesive or melted or sealed by other means against the wall of an outer coiled tubing. The seal exists at least at a lower end of the liner and might exist throughout the length of the liner. The sealing system illustrated in FIG. 3B involves inserting or installing a liner as inner tubing IT. The liner is installed with blowout plug 54 at a lower end. The blowout plug is attached to the lower end of inner tubing IT by an attachment means 52 of known shear strength. Such means are known in the art. The inside of the string could be pressured up to expand the liner. Flexible adhesive layer 50 should be activated as by heat, time, temperature or other known means. Once adhesive layer 50 has cured between liner IT and outer tubing OT pressure inside the string could be increased to blow blowout plug 54 out.

Figure 3C:
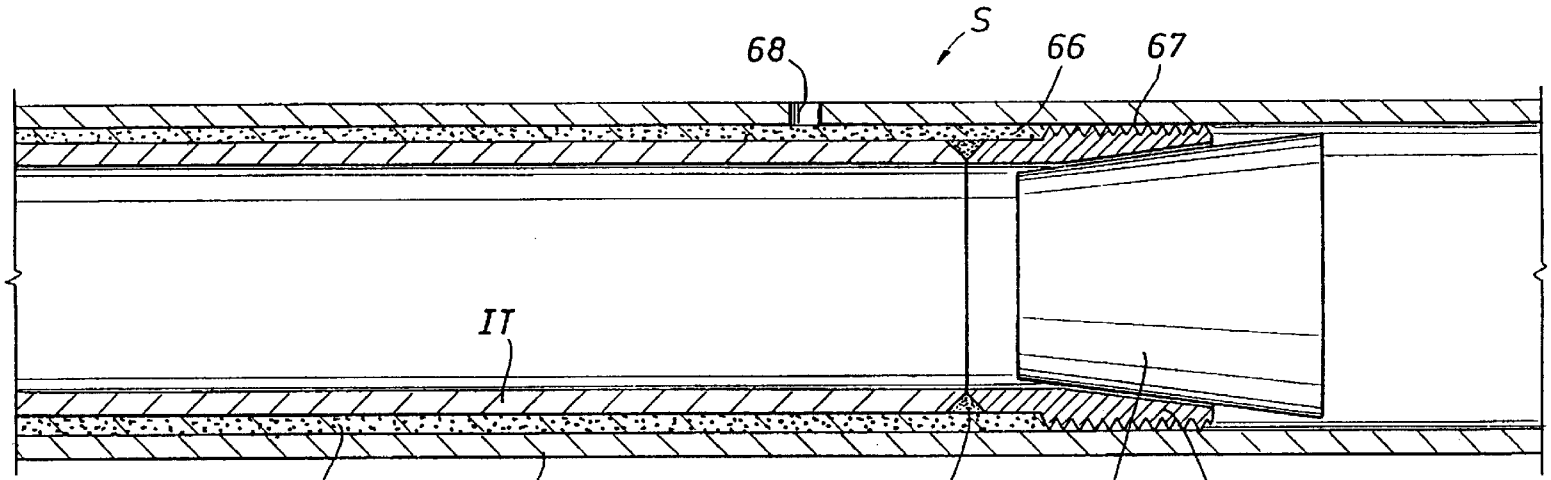

In the embodiment of FIG. 3C, the sealing system includes a hard connection as by welding, bracing, soldering, screws, glue or adhesive. Porthole 68 formed in outer tubing OT forms an access point for applying the hard connection material. Seal 66 offers an initial braze containment seal. Swage piston 62 can deform lower tubular section 69 having gripping surface 67 out in a pressure fit against the inside surface of outer tubing OT. Lower tubular section 69 is shown as welded at weld 64 to the lower portion of inner tubing IT. Braze, weld, glue, adhesive, or other similar material is inserted in the annulus between the annulus between inner tubing IT and outer tubing OT through port 68.

Figure 3D:
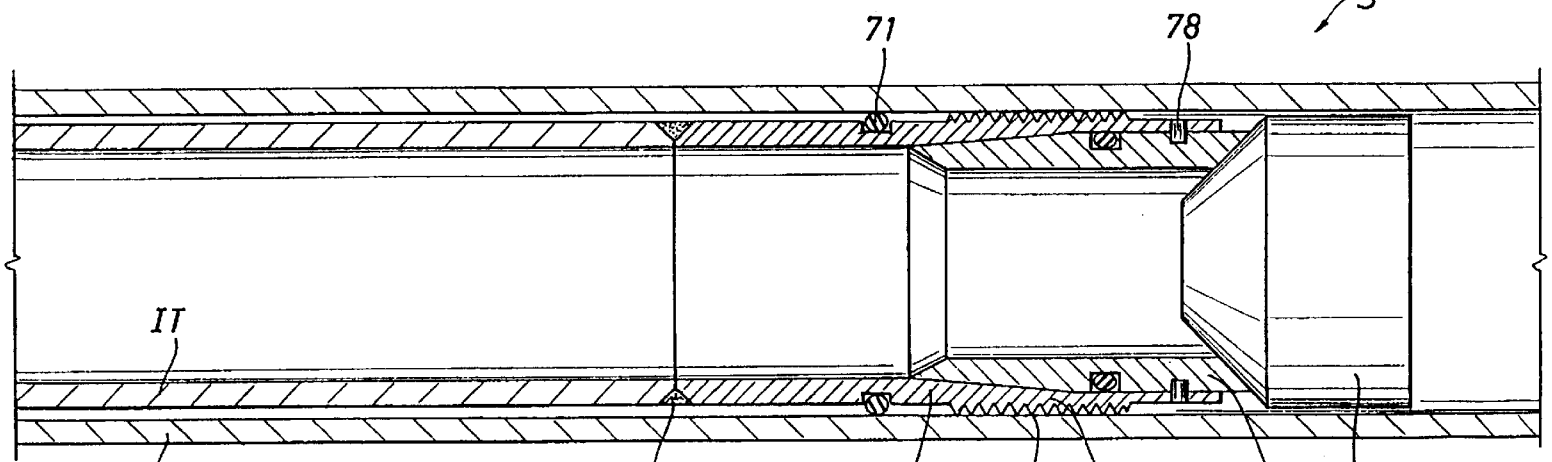

FIG. 3D illustrates a slip mechanism and seal. Swaging sleeve 74 is swaged by swage piston 76 to force slip mandrel 72 having gripping teeth 75 up against the inner wall of outer tubing OT. Inner tubing IT is connected such as by well 73 with slip mandrel 72. Seals such as O-ring 71 seal against fluid communication. Shear pins 78 hold swaging sleeve 74 in place until sheared by the pressure of swage piston 76.

Figure 5:
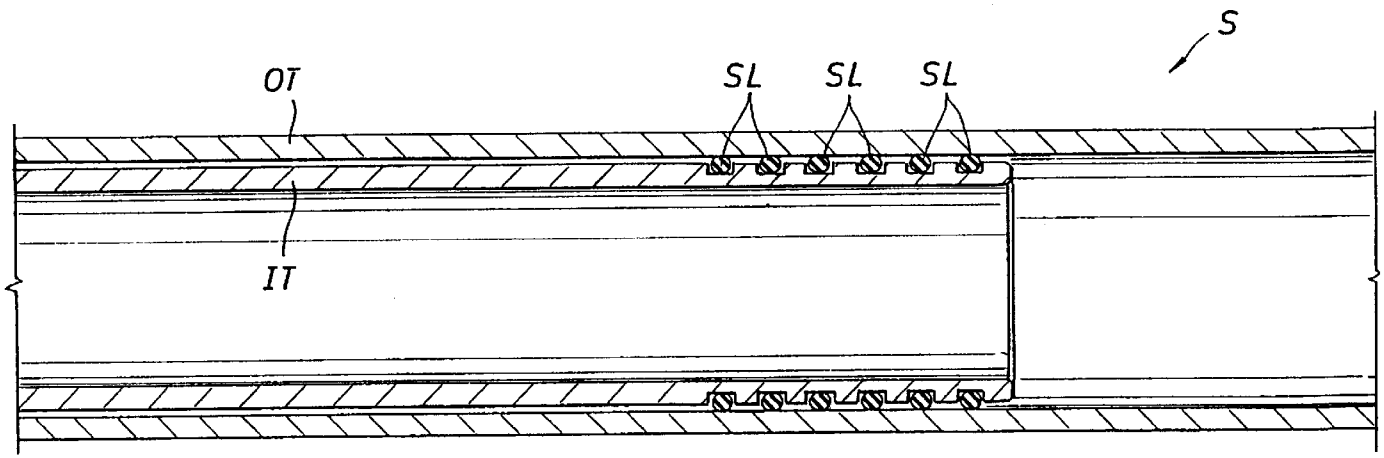
FIGS. 5 illustrates movable seals for sealing an annulus between an inner tubing and a coiled tubing string proximate an end of the inner tubing.
Figure 6:
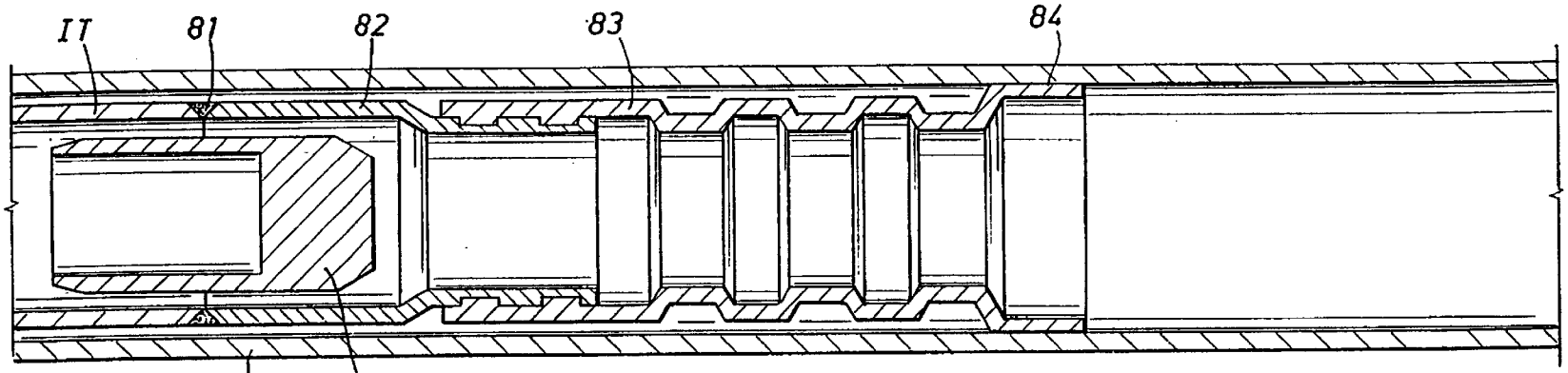
FIGS. 6 illustrates a deformable seal system.

An alternate technique for sealing between inner tubing IT and outer coil OT is illustrated in FIGS. 5 and 6. FIG. 5 illustrates moveable seal means SL as a series of sealing rings, probably O-rings. The rings might be structured to offer a better seal when placed in compression in one direction and to slide relatively freely when moved in the opposite direction. One method of assembly of inner tubing IT within outer coiled tubing OT, when a directional seal is envisioned, is to load the inner tubing within the outer coil by inserting the upper end of the inner tubing into the lower end of the outer tubing.

FIG. 6 illustrates a form of flexible or deformable seal. Element 80 functions as a bellows seal. Element 80 is attached to element 82 which is welded at well 81 to inner tubing IT inside outer tubing OT. Bellows seal 83 seals at seal 84 fixedly against the inside wall of outer tubing OT. Relative longitudinal movement of inner tubing IT inside of outer tubing OT will deform bellow seal 83 while leaving the end of bellow seal 83 fixedly sealed at 84 against the inside wall of outer tubing OT. A protective sleeve such as sleeve 80 may be used for seal installation and may be pumped out once the seal is in place.

Having devised a scheme to provide for a double barrier of safety in operations when circulating well fluids through coiled tubing, a further issue arises as to providing a double barrier of safety as the string is reeled into and out of the hole. In running out, at some point the inner coil, if it is shorter, will be raised above the wellhead.

For some PCCT operations it may be necessary to provide reverse flow protection while running in hole and while pulling out of hole when the barrier provided by the dual string is not in effect because all the dual string is spooled on the reel. In this instance a device to prevent reverse flow is required. Basically what is needed is a cyclic check valve that can be switched on, off and then on again. It should be low cost, simple and reliable, especially after having sand and debris circulated through it. The preferred embodiment is a blowout disc and a ball operated flapper check valve held open by a ported tube. By pressuring up on the CT the blowout disc can be ruptured allowing full reverse circulation. At the end of operations a ball can be circulated to shift the ported tube downwards allowing the check valve to return to full operating mode. Other embodiments include circulating a check valve down the CT after reverse operations are concluded and arranging for the valve to latch in a profile at the top of the reverse washing nozzle. A more complex valve arrangement would comprise a multi-position valve that could be de-activated by a ball and re-activated at the end of operations by circulating a second ball.

Figure 7A:
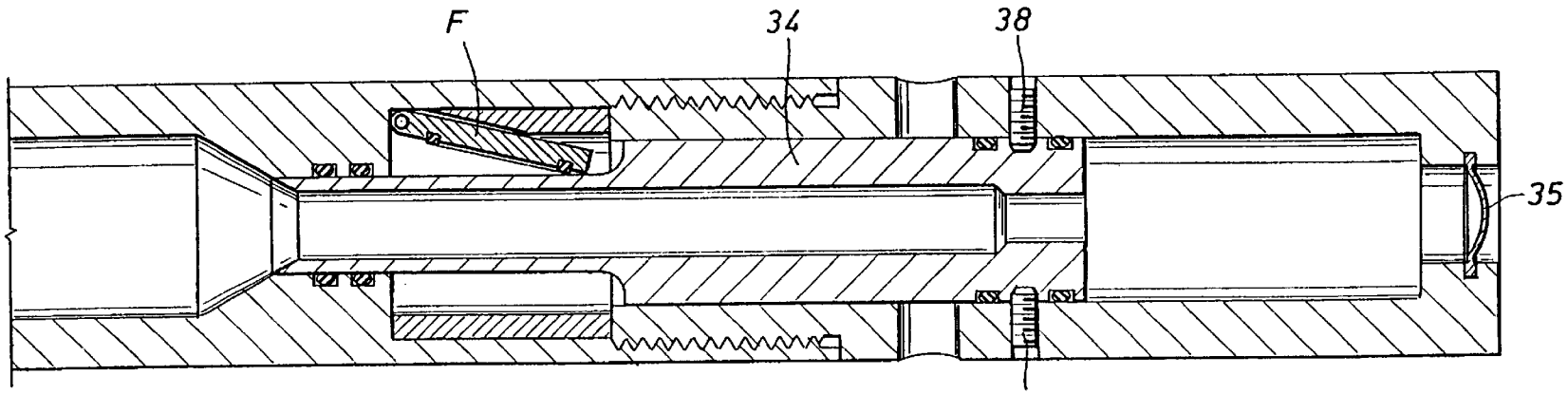
FIGS. 7A–7C illustrate a safety valve sub appropriate for use at the end of a coiled tubing string.
Figure 7B:
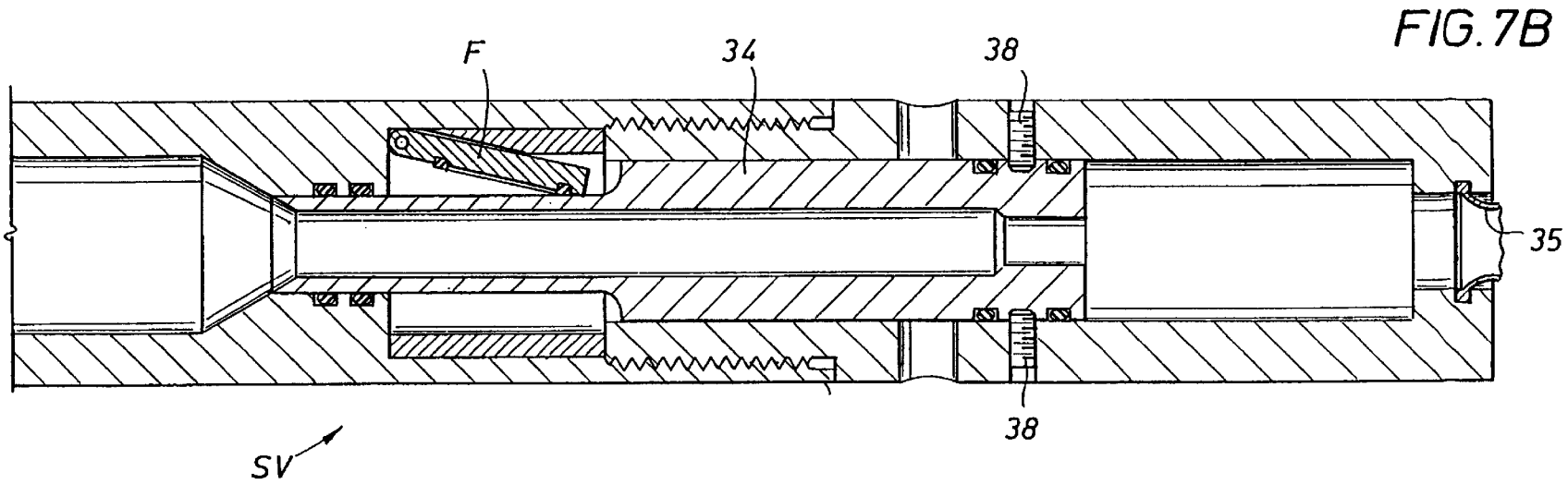
Figure 7C:
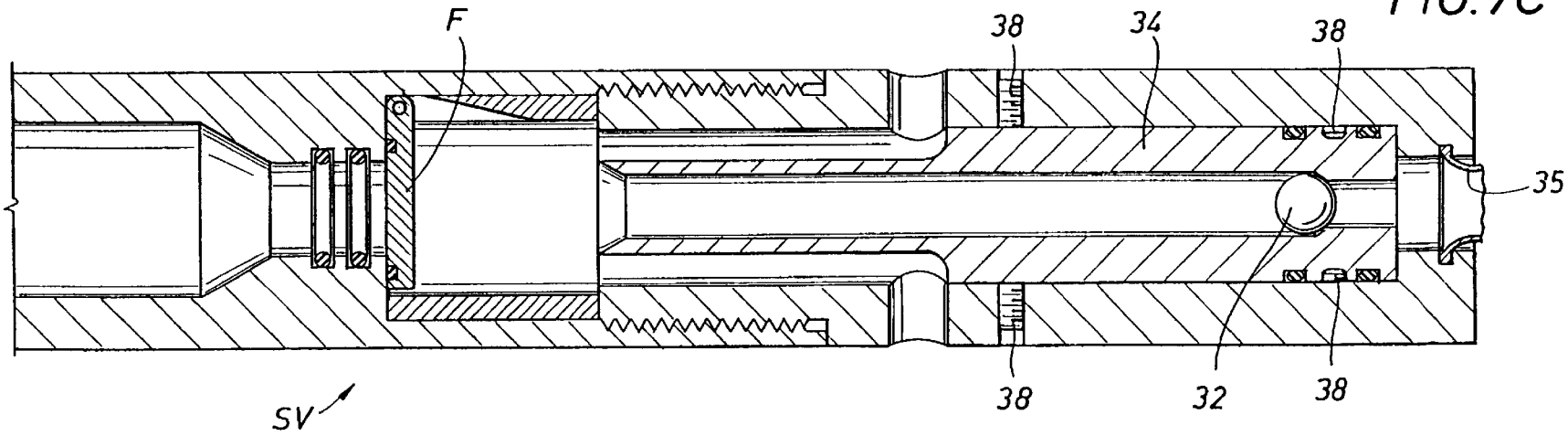

FIGS. 7A–7C illustrates a typical embodiment of the special check valve that might be used for regular PCCT operations in technically demanding jurisdictions, such as the North Sea. As illustrated in FIG. 7, to provide a second barrier of safety sub SV can be attached at or near the bottom of coiled tubing string S. Safety valve sub SV might have flapper F biased to close when fluid flows up, or when not pressured back, as is known in the industry. Such flapper F would be biased to close against seal 38 when flow down string S is no longer sufficient to overcome a selected biasing force. A further refinement includes a sleeve 34 that can be held in place by a sheer pins 38 and that would bias the flapper continuously open while in place. An initial burst disk 35 may be used to seal the string as illustrated in FIG. 7A. Initial burst disk 35 may be burst by the application of pressure down the string as shown in FIG. 7B. When initial burst disk 35 is burst, as illustrated in FIG. 7C, ball 32 may be then be sent through the coiled tubing string to land on top of sleeve 34 to shear pins 38. The application of pressure down the string subsequently moves sleeve 34 below flapper F in order to allow flapper F to perform as a safety valve. When sleeve 34 covers flapper F, flapper F would not close, whether or not fluid pressure is sufficiently strong downhole to overcome the flapper biasing means.

In operation, an at least partial dual tubing string would be deployed down a wellbore and most likely down production tubing. The top portion of the tubing string, preferably the top one-quarter to one-third of its length, would contain an inner tubing. Preferably the annulus, if any, between the inner tubing and the outer tubing is narrow. Any annulus would be sealed, preferably at least at or proximate an end portion of the inner tubing. If the annulus were sealed anew with each job, the location of the seal may be advantageously positioned per job rather than fixed in the string. The seal might be a continuous substance extending through the annulus. The seal might fill any space between the tubings, or the tubings might fit tightly against each other, in whole or in part. An annulus, if such exists, between an inner tubing and the outer tubing may be pressured up, such as with a high pressure gas, and the pressure monitored at the surface by suitable equipment. With the tubing string in place and the inner tubing extended below the wellhead, well fluid can be safely circulated, either up or down through the coiled tubing. The double barrier between the wellhead and a valve on the coiled tubing reel (or the like) provides a safety barrier at the surface against leaks in the coiled tubing string. Leaks in the coiled tubing string below the wellhead go into the annulus and could be controlled by the wellhead.

The foregoing disclosure and description of the invention are illustrative and explanatory thereof, and various changes in the size, shape, and materials, as well as in the details of the illustrated system may be made without departing from the spirit of the invention. The invention is claimed using terminology that depends upon a historic presumption that recitation of a single element covers one or more, and recitation of two elements covers two or more, and the like.

What is claimed is:

1. A coiled tubing string, comprising:

inner tubing within an outer coiled tubing;

the inner tubing being less than or equal to eighty-percent 80% of the length of the outer tubing;

the outside diameter of the inner tubing being greater than or equal to eighty-percent (80%) of the inside diameter of the outer tubing; and the inner tubing being sealed against the outer tubing at at least a lower portion of the inner tubing.

2. A coiled tubing string, comprising:

an inner tubing within outer coiled tubing; and at least one spoolable seal located within the outer tubing at at least a lower portion of the inner tubing for sealing the inner tubing against the outer tubing.

3. A coiled tubing string, comprising:

an inner tubing within outer coiled tubing; and a spoolable seal sealing the inner tubing against the outer tubing at at least a lower portion of the inner tubing, the seal structured to permit relative longitudinal motion between the inner tubing and the outer tubing.

4. A coiled tubing string, comprising:

an inner tubing within and sealed against outer coiled tubing at at least a lower portion of the inner tubing; and a stop located upon an inner surface of the outer tubing, wherein the portion of the coiled tubing string with the inner tubing sealed against the outer coiled tubing is spoolable about a coiled tubing reel.

5. A coiled tubing string, comprising:

inner tubing within outer coiled tubing;

the inner tubing being less than or equal to 80% of the length of the outer tubing;

the inner tubing connected to and sealed against the outer tubing at at least a lower portion of the inner tubing; and the connection between the inner tubing and the outer tubing structured to restrict relative longitudinal motion between the inner tubing and the outer tubing.

6. The apparatus of claim 1, 2, 3, 4 or 5 wherein the inner tubing comprises coiled tubing.

7. The apparatus of claim 6 wherein the inner tubing includes at least one of aluminum, titanium, beryllium-copper, corrosion resistant alloy material, plastic with or without reinforcement, and composite material.

8. The apparatus of claim 1, 2, 3, 4 or 5 that includes a pressurized fluid in an annulus defined between the inner tubing and the outer tubing.

9. The apparatus of claim 5 wherein a substance seals between the inner tubing and the outer tubing and restricts relative longitudinal motion between the inner tubing and the outer tubing.

10. The apparatus of claim 9 wherein the sealing substance includes at least one of the substances of weld, braze, solder and adhesive.

11. A protected coiled tubing string, comprising:

an upper string portion including an inner tubing within an outer coiled tubing, the inner tubing sealed against the outer tubing at at least a lower portion of the inner tubing; and a lower string portion connected to the upper string portion, the lower portion including a single coiled tubing length.

12. The apparatus of claim 1 wherein the inner tubing comprises a liner.

13. The apparatus of claim 12 wherein the liner is preformed.

14. The apparatus of claim 12 wherein the liner is formed within the outer tubing.

15. The apparatus of claim 3 wherein the seal includes at least one O-ring.

16. A coiled tubing string, comprising:

inner tubing within and sealed against outer coiled tubing at at least a lower portion of the inner tubing; and a stop located upon an inner surface of the outer tubing wherein the inner tubing is longitudinally compressed within the outer tubing against the stop.

17. A method for assembling a protected coiled tubing string, comprising:

inserting an inner tubing within an outer coiled tubing, the inner tubing being less than or equal to 80% of the length of the outer tubing; and sealing at least a lower portion of the inner tubing against the outer tubing such that the seal lies within the outer tubing.

18. The method of claim 17 that includes setting the seal chemically.

19. The method of claim 17 that includes setting the seal by radiation.

20. The method of claim 17 that includes setting the seal by heat.

21. The method of claim 17 that includes setting the seal mechanically.

22. A method for assembling a coiled tubing string, comprising:

attaching, a first coiled tubing length, having an inner tubing within an outer tubing and a sealed annulus defined between the inner tubing and the outer tubing, to a second single coiled tubing length to form a string.

23. A coiled tubing string, comprising:

inner tubing within an outer coiled tubing; and means for sealing against fluid communication the inner tubing against the outer tubing at at least a lower portion of the inner tubing, wherein the means for sealing is spoolable about a coiled tubing reel.

24. A method for assembling a protected coiled tubing string, comprising:

inserting an inner tubing within an outer coiled tubing; and providing a spoolable seal for sealing against fluid communication the inner tubing against the outer tubing.

25. A coiled tubing system for circulating fluids in a wellbore comprising:

a coiled tubing string;

a check valve attached to the coiled tubing string, the check valve having a fluid passageway therethrough and a biased flapper wherein the flapper is biased to close the fluid passageway to prevent fluid flow up through the check valve and into the coiled tubing string, the biasing force may be overcome to allow fluid flowed down the coiled tubing string and through the check valve; and a shiftable sleeve located in the fluid passageway of the check valve wherein the sleeve is shiftable from a first position where the sleeve prevents the flapper from closing the fluid passageway to allow reverse circulating through the valve and a second position where the biasing force may bias the flapper to close the fluid passageway.

26. The coiled tubing system of claim 25 wherein the coiled tubing string is a coil-in-coil tubing string.

27. The coiled tubing system of claim 25 wherein the shiftable sleeve includes a ball seat for receiving a ball wherein the sleeve may be shifted from the first position to the second position by fluid pressure applied to the ball when the ball is located in the ball seat.

28. The coiled tubing system of claim 25 wherein the sleeve is initially sheer pinned in the first position.

29. The coiled tubing system of claim 25 further comprising a frangible burst disk proximate to the leading end of the coiled tubing string to initially seal the coiled tubing string from wellbore fluids.

30. The coiled tubing system of claim 25 wherein the check valve is proximate to the leading end of the coiled tubing string.

31. A method of circulating fluids through a coiled tubing string comprising the steps of:

providing a cyclic check valve in the coil tubing string;

positioning the coil tubing string in a wellbore wherein an annulus is created about the outer diameter of the coiled tubing string;

circulating fluid down the annulus and up through the check valve and into the coiled tubing string; and cycling the check valve to prevent fluid flow from flowing up through the valve and into the coiled tubing.

32. The method of claim 31 further comprising providing a second smaller diameter coiled tubing string inside of the first coiled tubing string.

33. The method of claim 31 comprising the step of providing a shiftable sleeve within the check valve, and wherein the cycling step further comprises shifting the sleeve from a first position where fluid may be circulated up through the valve and into the coiled tubing to a second position where fluid is prevented from flowing up through the valve and into the coiled tubing.

34. The method of claim 31 further comprising shifting the sleeve from the first position to the second position by hydraulic pressure acting on a ball and ball seat arrangement on the sleeve.

35. The method of claim 31 further comprising providing a biased flapper in a fluid passageway in the check valve and shifting the sleeve from the first position to the second position wherein the sleeve holds the flapper open in the first position and the flapper may be biased closed when the sleeve is shifted to the second position.

36. A coiled tubing assembly for circulating fluid in a wellbore comprising:

a coiled tubing string, the string having a first end attached to a reel and a distal end for lowering into the wellbore;

a cyclic check valve attached proximate to the distal end of the coiled tubing string, the check valve having a fluid passageway therethrough and a valve closure means for preventing fluid flow up through the fluid passageway of the check valve and into the coiled tubing string; and a means for activating the valve closure means.

37. The coiled tubing assembly of claim 36 wherein the valve closure means is a biased flapper wherein the flapper has a biasing force that may be overcome to allow fluid flow down the coiled tubing and out the check valve.

38. The coiled tubing assembly of claim 37 wherein the means for activating the biased flapper is a shiftable sleeve wherein the sleeve is shiftable from a first position where the flapper is held open and a second position where the flapper is biased closed.

39. The coiled tubing assembly of claim 38 wherein the shiftable sleeve further comprises a ball seat for receiving a ball wherein the sleeve may be shifted from the first position to the second position by fluid pressure applied to the ball when the ball is located in the ball seat.

40. The coiled tubing assembly of claim 36 further comprising a second, smaller diameter coiled tubing string extending inside of the first coiled tubing string.

* * * * *